United States Patent [19]

Moser et al.

[11] Patent Number: 4,775,087

[45] Date of Patent: Oct. 4, 1988

[54] ARRANGEMENT FOR THE AUTOMATIC CONTROL OF THE STEP-BY-STEP ADVANCE OF A FOIL SHEET

[75] Inventors: Dieter M. Moser, Schönwald; Claus-Peter Lüth, Emmingen, both of Fed. Rep. of Germany

[73] Assignee: Vereinigte Numerierwerkefabriken Zeiser GmbH & Co., Emmingen, Fed. Rep. of Germany

[21] Appl. No.: 852,337

[22] Filed: Apr. 15, 1986

[30] Foreign Application Priority Data

Apr. 17, 1985 [DE] Fed. Rep. of Germany ..... 3513813

[51] Int. Cl.[4] ..... B65H 20/20; B41F 13/04

[52] U.S. Cl. ..... 226/143; 101/228

[58] Field of Search ..... 101/225, 228; 226/108, 226/115, 143

[56] References Cited

U.S. PATENT DOCUMENTS

| | | | |
|---|---|---|---|
| 3,887,122 | 6/1975 | Sommeria | 101/228 X |
| 4,095,732 | 6/1978 | Merritt | 226/143 X |
| 4,147,078 | 4/1979 | Bishop | 226/143 X |
| 4,158,301 | 6/1979 | Smith | 226/143 X |
| 4,334,471 | 6/1982 | Noyes et al. | 101/228 |
| 4,416,200 | 11/1983 | Yon | 226/143 X |

FOREIGN PATENT DOCUMENTS

| | | | |
|---|---|---|---|
| 2617418 | 11/1976 | Fed. Rep. of Germany | 101/228 |
| 2830932 | 2/1979 | Fed. Rep. of Germany | 101/228 |
| 2909358 | 9/1979 | Fed. Rep. of Germany | 101/228 |
| 2827942 | 1/1980 | Fed. Rep. of Germany | 101/228 |
| 3135696 | 3/1983 | Fed. Rep. of Germany . | |

*Primary Examiner*—Daniel P. Stodola

*Attorney, Agent, or Firm*—Neuman, Williams, Anderson & Olson

[57] ABSTRACT

Apparatus is described for moving a sheet to be machined in a step-by-step fashion. A continuously running machine, illustratively in the form of a printer, is disposed at a machine station. A motor drives a sheet mover to move the sheet in a first direction and in a second, opposite direction along a path past the machine station. The motor is selectively energized by a motor controller operating sequentially in a first mode to energize the motor whereby the sheet mover accelerates the sheet from a rest condition, in a second mode to energize the motor whereby the sheet is moved in the first direction synchronously with respect to the continuously running machine, while the continuously running machine machines the sheet, in a third mode to energize the motor to deaccelerate the sheet to rest condition, and before the next first mode, in a fourth mode to energize the motor, whereby the sheet mover moves the sheet in a second opposite direction a distance substantially equal to a sum of the distances that the sheet is moved during the first and third modes.

6 Claims, 2 Drawing Sheets

ARRANGEMENT FOR THE AUTOMATIC CONTROL OF THE STEP-BY-STEP ADVANCE OF A FOIL SHEET

BACKGROUND OF THE INVENTION

1. Field of the Invention

This invention relates to a process for the automatic control of the step-by-step advance of a foil sheet or the like, as well as an arrangement for carrying out said process.

2. Description of the Prior Art

As a continuously operating machine in the case of this process, for example, a printing machine, a punching machine or a similar machine may be used. This process can especially advantageously be used in the case of a printing machine having an approximately crescent-shaped printing roller and inking roller, in which case the degree of contact of the two rotating cylinders for the printing of different paper formats can be continuously adjusted in the direction of the roller circumference. The degree of contact of the two rollers is adjusted in such a way that these rollers, at the circumference, while the machine is operating during the so-called contact phase, have contact for a period of time that is as long as the length of the paper format to be printed. The part not used for machining or printing, such as the part of the roller circumference of a printing machine that is not used for printing, of the moving, preferably rotating machine parts will be called a vacant channel. In this vacant channel phase, the paper sheet is at rest, and the format to be printed, at the start of the contact phase, must move correctly on the printing roller with respect to position and synchronously with respect to the printing picture.

In the following, this invention relates to printing machines but is basically also suitable for the control of other foil sheets to be machined that may comprise any material, such as sheet metal or any similar material.

In the case of known processes of the initially mentioned type, usually no satisfactory result is obtained because the respective conveyed format of the foil sheet can be machined, for example printed, only partially and not precisely with respect to position. The reason is that the transport of the paper sheet in this case takes place by frictional connection with the pair of rollers which achieves a precisely synchronous operation with the roller surfaces, but no satisfactory precision as far as the position of the format with respect to the printing picture is concerned.

The paper must be accelerated starting from the rest position. This takes place at the start of the contact phase of the two rollers. Since physically and in practice, an infinite acceleration is not possible, the above-mentioned varying offset of the format with respect to the printing picture will occur in each case according to the random conditions that exist caused by a slip which first is not constant and secondly depends on the speed.

Naturally, no printing can take place during the acceleration phase. After the end of the contact phase, the paper, according to the speed, will follow for so long until the kinetic energy is used up by means of suitable measures (stoppers, etc.). Thus neither at the start of the transport, nor at the end of the transport, reproducible conditions exist that are required for achieving the desired results. In addition, because of the fact that the whole transported paper format is printed only partially, printing can, for example, not take place from fold to fold in the case of a Leporello-type folded reel paper.

The degree of contact of the two cylinders must necessarily be smaller than the transported format that is to be printed.

It is therefore required to accelerate the paper sheet starting from the rest position by means of a driving device until it moves synchronously with the printing roller. It is true that in this case the paper sheet is moved in forward direction but it cannot yet be printed because it does not yet move synchronously with the printing machine. This phase will be called lead run.

During the contact phase of the rollers, the paper sheet must be moved synchronously with respect to the roller because otherwise the paper will tear. After the end of the contact phase, at the start of the vacant channel, the paper sheet must be stopped. Because of the inertia of the moving parts, these parts, despite extensive braking, continue to move a little further in forward direction. This phase will be called overrun.

SUMMARY OF THE INVENTION

It is an object of this invention to provide a new and improved process and an arrangement that permit an uninterrupted machining, for example printing, of a foil sheet, especially a printing of a Leporello-type folded reel paper, from fold to fold.

In accordance with this and other objects of this invention, there is disclosed a method of sheet feeding including the pulling-back of a foil sheet or the like whereby, the contact phase can be adjusted in such a way that it corresponds precisely to the selected format. For example, the printing of a folded paper sheet is possible from fold to fold. Since the lead run and the overrun of the paper sheet are compensated by the backward operating of the driving motor, effectively during a working cycle, only the adjusted and printed paper format is transported.

In the case of a preferred embodiment the synchronous movement between the machine and the foil sheet, to be on the safe side, is somewhat longer than the actual format movement; i.e., it starts a little earlier and ends a little later. In this case, the foil sheet must naturally, after the end of the overrun, also still be pulled back by the distance that corresponds to the difference between the synchronous movement and the format movement.

When the degree of contact of the printing rollers of a printing machine is adjusted to be somewhat larger than the paper format to be printed, printing can even, on both sides, take place beyond the paper format, if this is desirable.

In an illustrative embodiment, apparatus is provided for controlling the step-by-step advance of a sheet to be machined. The sheet advance controlling apparatus comprises a continuously running machine disposed at a machine station, an energized motor, a sheet mover driven by the motor for moving the sheet in a first direction and in a second, opposite direction along a path past the machine station, and a motor controller for controlling the step-by-step energization of the motor. The motor controller operates sequentially in a first mode to energize the motor whereby the sheet mover accelerates the sheet from a rest condition, in a second mode to energize the motor whereby the sheet is moved in the first direction synchronously with respect to the continuously running machine, while the continuously running machine machines the sheet, in a third mode to energize the motor to deaccelerate the sheet to the rest condition, and before the next first mode, in a fourth mode to energize the motor, whereby the sheet mover moves the sheet in the second opposite direction. The motor controller comprises a sensor coupled to the motor for generating timing pulses indicative of the velocity of and direction of rotation of the motor, and a counter for selectively receiving and counting the timing pulses during respectively at least a portion of the first mode, the second mode, the third mode, and the fourth mode, for controlling the energization of the motor to determine the length of the fourth mode in accordance with the counted timing pulses.

In a preferred embodiment of the apparatus the control and counting device comprises an electronic control unit and three counters operative in the indicated sequence for counting the forward timing pulses to control the motor for the transport of the foil sheet. This permits a precise forward and backward control of the motor in such a way that always only the format of the foil sheet processed in the continuously operating machine is moved along after a complete working cycle of the apparatus.

The counting of the lead run and of the format movement in this embodiment must not correspond precisely to the lead run and the format movement. The reason for this operation is that when the synchronous movement that practically corresponds to the maximum contact phase of the two sheet drive rollers in the case of a printing machine, at the start and at the end, reaches somewhat beyond the format movement that corresponds to the printing phase in the case of a printing machine, the two sections of the synchronous movement that move beyond the start and the end of the format movement can, in addition, be counted in the lead run counter and are therefore taken into account during the return movement. As a result, the counting of the lead run may be by these two differential sections longer than the actual lead run. This may be achieved by a corresponding adjustment carried out before the operation of the lead run timing pulse number in the lead run counter. Only when the timing pulse counting in the lead run counter reaches this precisely adjusted pulse number, does the lead run counting end, and the other timing pulses of the motor rotation pulse emitter are counted in the format counter. Therefore, in this embodiment, this changing-over may not take place before the actual format movement or the pressure phase occurs. The counting in the format counter will end when the counting of the timing pulses has reached the format timing pulse number that is variably adjusted according to the machined format. This point in time coincides with the end of the synchronous movement or the contact phase of the sheet drive rollers in the case of a printing machine.

BRIEF DESCRIPTION OF THE DRAWINGS

A preferred embodiment of the following the arrangement according to the invention is explained by means of figures, in which case a paper sheet is provided as the foil sheet and a printing machine is provided as the continuously operating machine.

DETAILED DESCRIPTION OF THE PREFERRED EMBODIMENT

Figure 1:
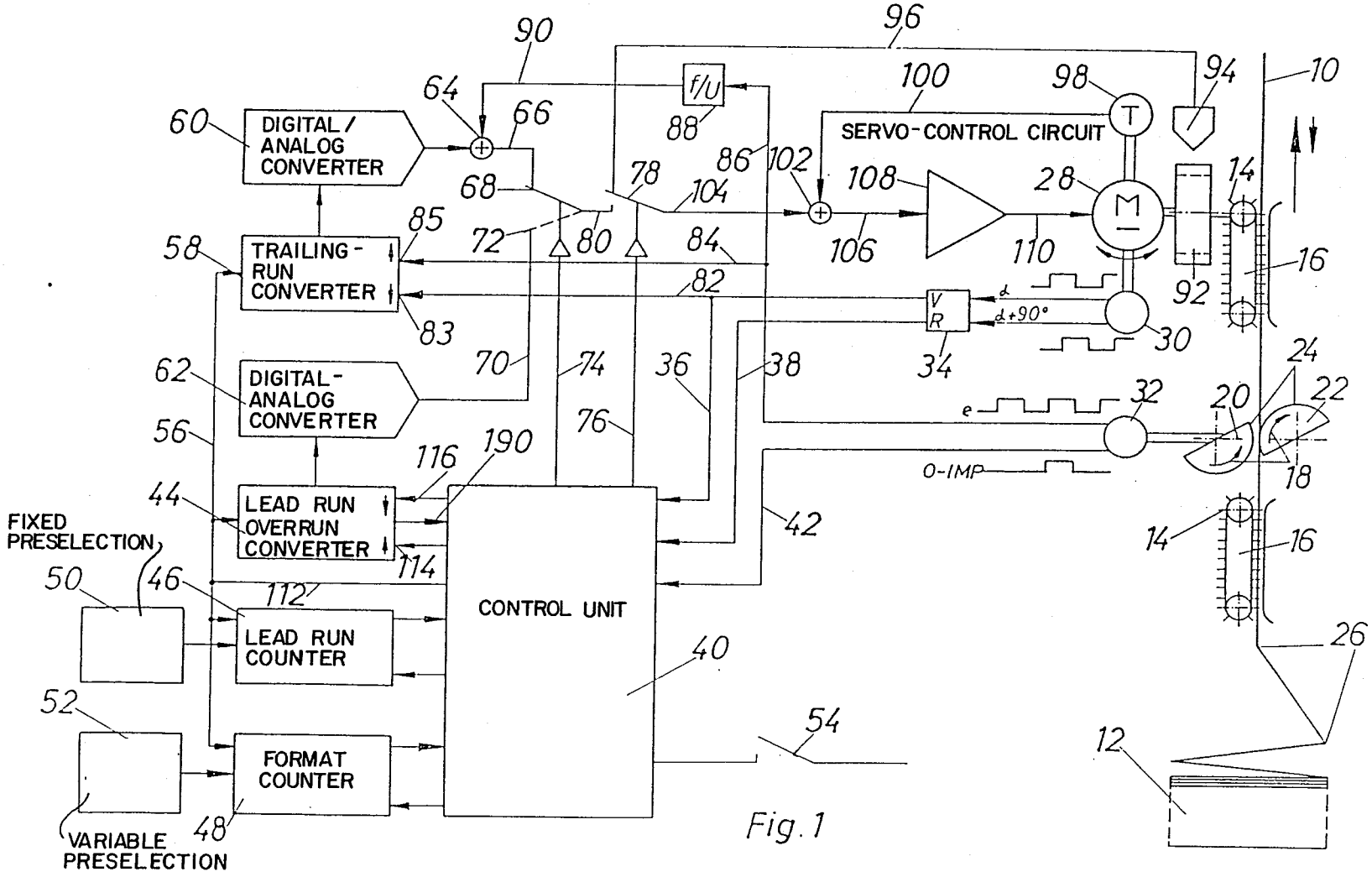
FIG. 1 is a block diagram of the operation of the embodiment.

According to FIG. 1, a paper sheet 10 illustratively in a Leoporello-type folded condition, is pulled off a pile 12 and, by means of pin feed attachments 14 engaging in tracks of punched holes at the edge of the paper sheet, by two traction devices 16, is transported through a printing machine arranged between the traction devices. Only two rollers of the printing machine rotating in the direction of the arrows 18 that are semicircular in their profiles are shown, namely printing roller 20 and inking roller 22. In their rotating position, the rollers 20 and 22 are mutually adjusted in such a way that the contact length of their printing surfaces 24 corresponds to approximately the length of the respectively used paper format between two folds 26.

The two traction devices 16, in a way that is not shown in detail, are synchronously driven by an electric motor 28. The electric motor 28 and the printing roller 20, in each case, are connected with a rotation pulse emitter 30 and 32. When the motor 28 rotates forward, the rotation pulse emitter 30 feeds timing pulses d, and when the motor 28 rotates backward, feeds timing pulses d+90° to a direction discriminator 34 that feeds forward and backward pulses, via separate lines 36 and 38, to two inputs of an electronic control unit 40. At the start of each lead run of the paper sheet 10, the rotation pulse emitter 32 feeds a zero pulse via a line 42 to a third input of the control unit 40. Connected to the control unit 40, are lead-run/overrun counter 44 implemented by an upward/downward counter, a lead-run counter 46 and a format counter 48. The lead-run counter 46 has a fixed preselection device 50 by means of which, in the lead-run counter, a lead-run timing pulse number can be adjusted that corresponds to the respective operation of the printing machine. The format counter 48 has a variable preselection device 52 by means of which in the format counter 48, a format timing pulse number can be adjusted that corresponds to the respective used paper format. While the lead-run timing pulse number in the lead-run counter, during the operation of a certain printing machine, usually remains fixed, the format timing pulse number in the format counter is changed frequently according to the used paper format.

Another input of the control unit 40 is connected with an on/off switch 54 that is not shown in detail and controls the transport release of the traction devices 16. The lead-run/overrun counter 44, the lead-run counter 46 and the format counter 48, via a joint line 56, are connected with a trailing-run counter 58 which itself is connected with a digital-analog converter 60 for converting the counting pulses stored in it. In the same way, the lead-run/overrun counter 44 is connected with a digital/analog converter 62.

The output of the digital/analog converter 60 is connected with an adding point 64 which itself, via a line 66, is connected with a switch 68. The output of the digital/analog converter 62, via a line 70, is connected with a switch 72, and two outputs of the control unit 40, via lines 74 and 76, are connected with the switches 68 and 72 and with switches 78 and 80. The direction discriminator 34, via a line 82, is connected with the downward-counting input 83, and the rotation pulse emitted 32, via a line 84, is connected with the upward-counting input 85 of the trailing-run counter 58. Via another line 86, the rotation pulse emitter 32 feeds timing pulses e to a frequency-voltage converter 88 which itself, via a line 90, is connected with the adding point 64.

On the shaft of the electric motor 28, a toothed wheel 92 is fastened that is scanned by a sensor 94. The sensor 94, via a line 96, is connected with the switch 78. The electric motor 28 is also connected with a tachometer 98 that, via a line 100, is connected with an adding point 102. The adding point 102, via a line 104, is connected with the switch 78 and, via a line 106, is connected with a servo-amplified 108 that, via a line 110, is connected to the electric motor 28. The tachometer 98 is used for the actual-value formation for a servo control circuit that is known per se and consists of the electric motor 28, the tachometer 98, the adding point 102 and the servo-amplifier 108. When the electric motor 28 rotates and thus the toothed wheel 92, the sensor 94 generates an approximately sinusoidal signal, in which case, the zero crossover of the signal coincides with the reference point of the servo-amplifier 18. The pitch of the toothed wheel 92 is dimensioned to be such that the passage of each paper format produces an integral multiple of the signal period of the sensor 94. This means that the length of all common paper formats can be expressed as an integral multiple of the signals periods of the sensor 94.

When the switch 78 is closed, the servo-control circuit will find the closest stable point on one of the two signal edges of the sensor 94 and fix the drive there. When in this condition, while the roller 20, 22 is operating, the transport release takes place by the closing of the switch 54, the control unit 40, when the zero pulse of the rotation pulse emitter 32 arrives, will set the counters 44, 46, and 48 back to zero, while the trailing-run counter 58 will be charged by the control unit 40 via a line 112 to half the value of its total capacity. The digital/analog converter 60 is of the bipolar type. As a result, a voltage of zero V will at this moment be located at its output.

The frequency-voltage converter 88 furnishes a voltage that is proportional to the speed of the rollers 20 and 22 of the printing machine and applies it to the adding point 64. When now, by means of the control unit 40, the switches 68 and 80 are closed, the voltage from the adding point 64 reaches the adding point 102, by means of which the servo-control circuit tries to let the electric motor 28 run at such a speed that a voltage of zero V exists at the input of the servo-amplifier 108. For this purpose, the tachometer 98 must furnish a voltage of the same amount, but of opposite polarity.

The timing pulses e of the rotation pulse emitter 32 arrive at the upward-counting input 85 of the trailing-run counter 58, the timing pulses d arrive at the downward-counting input, only when the electric motor 28 runs forward. The rotating direction is recognized by the direction discriminator 34.

Caused by the mass inertia of the whole paper-sheet drive, a speed of the electric motor that is synchronous with respect to the printing cylinders 20, 22 cannot be reached in the time zero. As a result, the counter reading of the trailing-run counter 58 will increase which generates a rising voltage at the output of the digital-/analog converter 60. As a result, the electric motor 28 assumes a supersynchronous speed, namely, until a voltage of zero V exists again at the output of the digital-/analog converter 60. The paper sheet 10 will then move synchronously with respect to the pair of rollers 20, 22 as far as the speed and the phases are concerned.

The lead-run/overrun counter 44, controlled by the control unit 40, receives, at its upward-counting input 114, forward-pulses from the direction discriminator 34 until the lead-run counter 46 receiving the same timing pulses has reached a counter reading that corresponds to the lead-run timing pulse number adjusted by means of the fixed preselection device 50. Subsequently, the format counter 48 is released by the control unit 40 and will now receive the forward pulses from the direction discriminator 34. When a counter reading is reached that corresponds to the format timing pulse number preset by the variable preselection device 52, the lead-run/overrun counter 44 is released and will now receive forward pulses. At the same time, the switch 68 is opened and the switch 72 is closed.

Now a negative voltage will be present at the output of the digital/analog converter 60, the amount of the negative voltage being proportional to the length of the lead run determined by the adjusted lead-run timing pulse number. This negative voltage reaches the adding point 102 via the closed switches 72 and 78. The contact phase of the rollers 20 and 22 has already come to an end; i.e., the so-called vacant channel starts now.

The servo control circuit will now seek to change the rotating direction of the electric motor 28 by trying to counteract the negative voltage at the adding point 102 by means of the tachometer 98. Again, as a result of the mass inertia of the whole paper sheet drive, this change of rotating direction does not take place suddenly. The electric motor 28 is first decelerated until it stops in order to then be accelerated to a speed that corresponds to the voltage at the adding point 102. Up to the stoppage before the rotating direction reversal of the electric motor 28, a number of forward pulses will still reach the upward-counting input of the forward-overrun counter 44 from the direction discriminator 34. This is the so-called overrun which is naturally larger in the case of higher machine rotating speeds that in the case of lower ones.

From the point in time of the rotating direction reversal to the stoppage, the electric motor 28 will continue to run until the counter reading of the lead-run/overrun counter 44 has reached a zero value by furnishing timing pulses at the downward-counting output 116 of the control unit 40. Subsequently, stoppage of the paper sheet 10 will occur. The return movement corresponds exactly to the lead run adjusted by means of the fixed preselection device 50 plus overrun.

The zero counter reading in the lead-run overrun counter 44 is reported to the control unit 40, by means of which the switch 78 is closed, and the servo control circuit responds to the corresponding signal edge of the toothed wheel 92 and of the sensor 94.

As soon as the rotation pulse emitter 32 supplies the next zero pulse to the control unit 40, the working cycle of the arrangement will start again.

Figure 2:
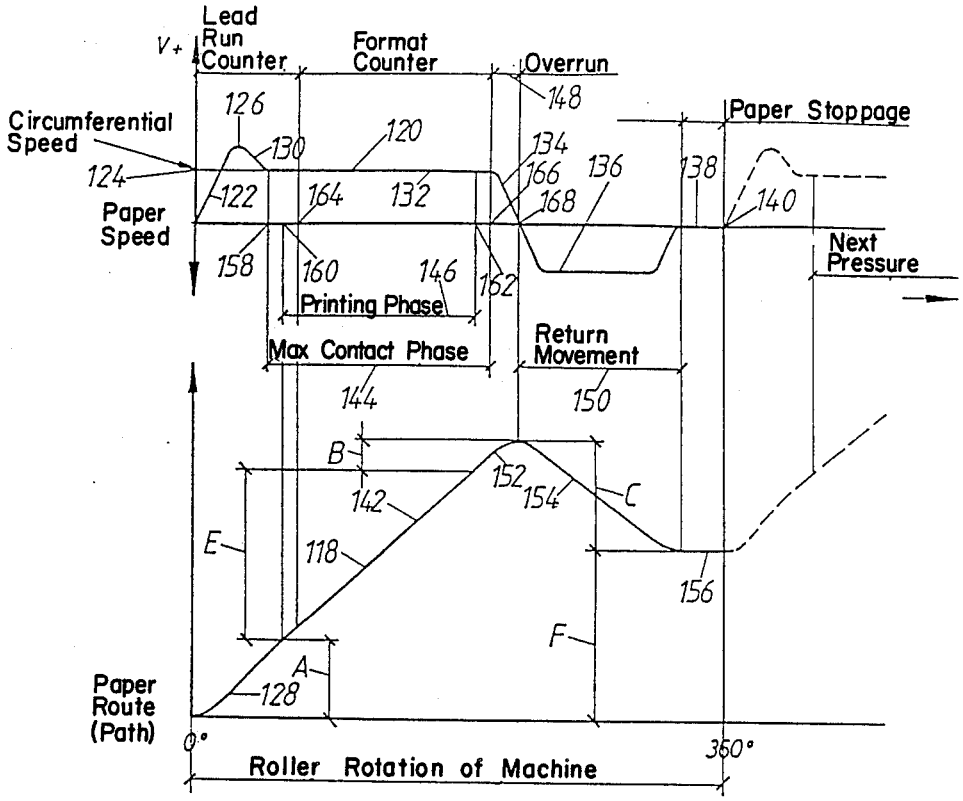
FIG. 2 is a sequence diagram of the paper transport in the arrangement according to the invention.

FIG. 2 shows a curve 118 indicating the feed length of the paper sheet 10 on the abscissa in arbitrary units of length, as a function of the angular degrees of the roller rotation of the rollers 20, 22 of the printing machine indicated on the abscissa. In addition, in the upper part of FIG. 2, a curve 120 is shown that reflects the paper speed of the paper sheet 10 entered on the ordinate in arbitrary speed units, as a function of the roller rotation of the printing machine. The curve 120 shows that at first, in a section 122, the paper speed rises steeply from zero and exceeds the circumferential speed 124 of the printing rollers 20, 22 up to a maximum 126. The selection 128 of the paper feed length shows that because the paper speed exceeds the maximum 126, the position of the paper sheet 10 is fed toward the circumferential position of the cylinders 20, 22. Then, by means of the servo control circuit, in a section 130 of the curve 120, the paper speed is returned to the circumferential speed 124 of the rollers 20, 22. Shown here, in a section 132, is the synchronous movement of the paper 10 with respect to the cylinders, followed by a braking section 134 that changes into a return run 136 of the paper sheet; at the end of this process a section 138 brings the paper 10 to a stop. A new work cycle of the arrangement starts at point 140.

After the approaching or trailing run section 128 of the paper sheet 10 is a straight section 142 in curve 118 that corresponds to the synchronous engagement between the paper sheet 10 and the rollers 20, 22. The maximum contact phase is characterized by abscissa section 144. The actual printing phase 146 that corresponds to the format movement starts a little later and stops a little earlier than the maximum contact phase 146. After the contact phase 144 is an abscissa section 148 that corresponds to the overrun of the paper sheet 10 shown in section 152 of the curve 118. At the zero crossover of the paper speed curve 120, the return run of the paper sheet 10 starts as is shown in curve section 154 and corresponds to abscissa section 150. During abscissa section 138 of curve 120 that corresponds to the paper stoppage, the corresponding horizontal section 156 of the curve 118 occurs.

Actually, the lead run could end at abscissa point 158 that corresponds to the start of the contact phase or of the synchronous movement. Since, however, the printing phase does not start before abscissa point 160 and ends shortly before the end of the contact phase 144, namely at abscissa point 162, the paper paths covered in the two differental sections between the start and the end of the contact phase and the printing phase must also still be taken into account during the return movement. They are therefore still counted in the lead-run counter, so that the lead run, with respect to its counting, does not end before abscissa point 164. Subsequently, the format counter is switched on and the actual format movement starts in the section between the abscissa point 164 and 166. For the indicated reasons, it does not overlap with the printing phase 146 but is as long as it. The overrun 148 extends from the abscissa point 166 to the zero crossover 168 of the paper speed curve 120.

In section 128 of curve 118, the paper sheet 10 moves a distance A to the end of the actual lead run, i.e., the lead run that is not extended by the difference at the end of the contact phase. During the actual printing phase 146, the paper sheet 10 in section 142 of the curve 118 is moved a distance E. This is followed by section 152 during which the paper sheet 10 is moved a distance B that corresponds to the overrun 148 and to the difference between the contact phase 144 and the printing phase 146 at the end of these two phases. In return-run section 154 of the curve 118, the paper sheet moves backward by the distance C. This distance C backwards corresponds to the sum of the two distances A and B. The distance E that the paper sheet 10 moves during the printing phase 146 is identical to the entire length F that the paper sheet 10 is fed during the whole working cycle of the machine and corresponds to the used paper as indicated by the format counter.

Figure 3:
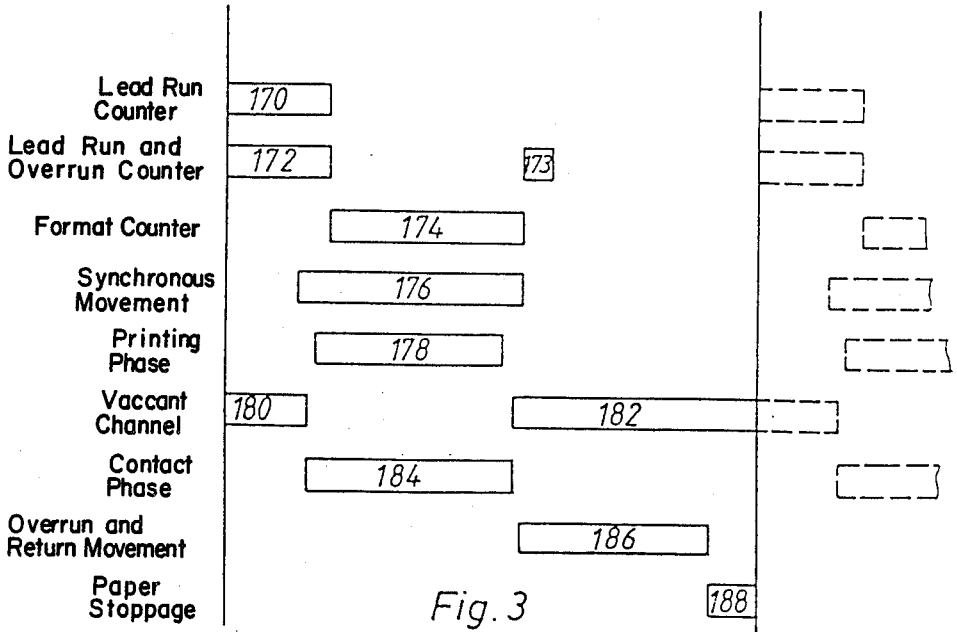
FIG. 3 is a block representation of the time sequence of the operation of the machine according to the invention.

In FIG. 3, the different ON-times and stoppage times of the arrangement according to the invention are shown above the same abscissa (as indicative of roller rotation) as the one shown in FIG. 2. The block 170 corresponds to the lead-run timing pulse number adjusted in the fixed preselection device 50 and thus to the ON-duration of the lead-run counter 46. According to block 172, the lead-run/overrun counter is at first switched on as long as the lead-run counter, but according to block 173, during the overrun 148, receives more timing pulses. Between the end of block 172 and the start of block 173, the timing pulses of the rotation pulse emitter 30 according to block 174 are counted in the format counter 48. The synchronous movement 176 that corresponds to the maximum contact phase 144 is longer than the block 174 to the difference between the contact phase 144 and the printing phase 146. The printing phase 146 corresponds to block 178. In reality, however, the maximum contact phase 144 will not be utilized completely but the vacant channel according to block 180 will not end until shortly before the start of the printing phase 178 and starts again shortly after the end of the printing phase according to block 182. The actually utilized contact phase according to block 184 is therefore shorter than the synchronous movement 176 that corresponds to the maximum contact phase 144. The sum of overrun 148 and return run 150 is contained in block 186, and paper stoppage 138 corresponds to block 188.

We claim:

1. Apparatus for moving in a step-by-step fashion a sheet to be machined, said sheet moving apparatus comprises:

(a) a continuously running machine disposed at a machine station;

(b) an energizable motor;

(c) means driven by said motor for moving the sheet in a first direction and in a second, opposite direction along a path past said machine station; and (d) means for controlling the step-by-step energization of said motor to operate sequentially in a first mode to energize said motor whereby said sheet moving means accelerate the sheet from a rest condition, in a second mode to energize said motor whereby the sheet is moved in said first direction synchronously with respect to said continuously running machine, while said continuously running machine machines the sheet during its machining period, in a third mode to energize said motor to deaccelerate the sheet to the rest condition, and before the next first mode, in a fourth mode to energize said motor, whereby said sheet moving means moves the sheet in a second, opposite direction, said controlling means comprising:

(1) means coupled to said motor for generating timing pulses indicative of the velocity of and direction of rotation of said motor and thus of the speed and direction of the sheet to be machined;

(2) counting means for selectively receiving and counting said timing pulses during respectively at least a portion of said first mode, said second mode, said third mode, and said fourth mode for controlling the energization of said motor to determine in accordance with the counted timing pulses the distance that the sheet is moved during said fourth mode to be not less than a sum of the distances that the sheet is moved during said first and third modes;

(3) means for setting the duration of said second mode to be not less than said machining period; and (4) means for initiating and terminating said second mode before the beginning and after the end of said machining period, and said sheet moving means moves the sheet in said second opposite direction a further distance corresponding to that distance that said sheet was moved in said first direction during those portions of said second mode which do not overlap said machining period.

2. The sheet moving apparatus as claimed in claim 1, wherein there is included a toothed wheel coupled to said motor whereby said toothed wheel is rotated upon the energization of said motor, a sensor disposed to sense the rotation of said toothed wheel to provide a signal indicative of the rotational velocity of said motor, said servo control means responsive to said signal for controlling the energization of said motor.

3. The sheet moving apparatus as claimed in claim 1, wherein said controlling means comprises means for setting the duration of said second mode to be not less than said machining periods.

4. The sheet moving apparatus as claimed in claim 3, wherein said controlling means comprises means for initiating and terminating said second mode before the beginning and after the end of said machining period, and said sheet moving means moves the sheet in said second opposite direction a further distance corresponding to the distance that said sheet was moved in said first direction during those portions of said second mode which do not overlap said machining period.

5. Apparatus for moving in a step-by-step fashion a sheet to be machined, said sheet moving apparatus comprises:

(a) a continuously running machine disposed at a machine station;

(b) an energizable motor;

(c) means driven by said motor for moving the sheet in a first direction and in a second, opposite direction along a path past said machine station; and (d) means for controlling the step-by-step energization of said motor to operate sequentially in a first mode to energize said motor whereby said sheet moving means accelerates the sheet from a rest condition, in a second mode to energize said motor whereby the sheet is moved in said first direction synchronously with respect to said continuously running machine, while said continuously running machine machines the sheet, in a third mode to energize said motor to deaccelerate the sheet to the rest condition, and before the next first mode, in a fourth mode to energize said motor, whereby the sheet moving means moves the sheet in a second, opposite direction, said controlling means comprising:

(1) means coupled to said motor for generating timing pulses indicative of the velocity of and direction of rotation of said motor; and (2) counting means for selectively receiving and counting said timing pulses during respectively at least a portion of said first mode, said second mode, said third mode, and said fourth mode for controlling the energization of said motor to determine the length of said fourth mode in accordance with the counted timing pulses, said counting means comprising a first counter, a second counter and a third counter, first means for entering a first preselected number in said first counter, second means for entering a second preselected variable number in said third counter, means before the beginning of said first mode for resetting said first, second and third counters to their initial counts and for initiating the counting of said timing pulses by said first and second counters, said first counter for counting said timing pulses until said first number is reached to terminate the counting of said second counter and to initiate the counting of said timing pulses by said third counter, said third counter responsive to the counting of said timing impulses until said second number is reached to terminate its counting and to initiate the counting of said timing pulses by said second counter, and means responsive to the beginning of said fourth mode for applying said timing pulses to said second counter, whereby said second counter counts said timing pulses in an opposite sense toward its initial count.

6. The sheet moving apparatus as claimed in claim 5, wherein said first means sets said first number as the difference between the timing pulses counted during said second mode and said timing pulses occurring during said machining of the sheet.

* * * * *